US011801707B1

(12) United States Patent
Snider, Jr.

(10) Patent No.: US 11,801,707 B1
(45) Date of Patent: Oct. 31, 2023

(54) CEMENT SIDING TOLERANCE DEVICE AND MEASUREMENT TOOL

(71) Applicant: Franklin Snider, Jr., Linwood, NC (US)

(72) Inventor: Franklin Snider, Jr., Linwood, NC (US)

( * ) Notice: Subject to any disclaimer, the term of this patent is extended or adjusted under 35 U.S.C. 154(b) by 673 days.

(21) Appl. No.: 17/025,416

(22) Filed: Sep. 18, 2020

(51) Int. Cl.

| | |
|---|---|
| ***B25B 5/00*** | (2006.01) |
| ***B43L 7/00*** | (2006.01) |
| ***E04F 21/18*** | (2006.01) |
| ***B43L 13/02*** | (2006.01) |
| ***B43L 7/10*** | (2006.01) |
| ***B43L 7/14*** | (2006.01) |
| ***E04D 15/02*** | (2006.01) |
| ***B25H 7/02*** | (2006.01) |

(52) U.S. Cl.
CPC ..... *B43L 7/005* (2013.01); *B25H 7/02* (2013.01); *B43L 7/10* (2013.01); *B43L 7/14* (2013.01); *B43L 13/028* (2013.01); *E04D 15/025* (2013.01); *E04F 21/1855* (2013.01); *E04F 21/1883* (2013.01)

(58) Field of Classification Search
CPC .. B25B 5/00; B25B 5/14; B25B 5/064; B25B 5/06; B25B 5/02
See application file for complete search history.

(56) References Cited

U.S. PATENT DOCUMENTS

| | | | | |
|---|---|---|---|---|
| 372,221 | A * | 10/1887 | Hubbard et al. .... | E04F 21/1855 33/647 |
| 631,315 | A * | 8/1899 | Meskill ..... | E04F 21/1855 33/647 |
| 4,237,614 | A * | 12/1980 | Williams ..... | E04F 21/00 269/904 |
| 4,654,975 | A * | 4/1987 | Lopez ..... | B25C 7/00 33/646 |
| 5,465,499 | A | 11/1995 | LaPlante | |
| 5,950,321 | A | 9/1999 | Pena et al. | |
| 6,684,521 | B2 | 2/2004 | Rempe | |
| 6,705,021 | B2 | 3/2004 | Nadal et al. | |
| 6,836,969 | B1 | 1/2005 | Bates | |
| 6,886,268 | B1 | 5/2005 | Morse | |
| 7,159,328 | B1 | 1/2007 | Duda | |
| 7,490,447 | B2 | 2/2009 | Ouellette et al. | |
| 7,574,814 | B2 | 8/2009 | Arsson | |
| 8,359,762 | B1 | 1/2013 | Blasi | |
| 9,206,613 | B2 | 12/2015 | Walker | |
| 9,951,534 | B2 | 4/2018 | Menges | |
| 10,544,594 | B2 | 1/2020 | Merrick et al. | |

(Continued)

*Primary Examiner* — Lee D Wilson
(74) *Attorney, Agent, or Firm* — Albert Bordas, P.A.

(57) ABSTRACT

A cement siding tolerance device and measurement tool, which has a main panel having a tab and a ridge, whereby the tab and the ridge perpendicularly extend from the main panel at opposite sides. The main panel has a front face, a rear face, a top edge, a bottom edge, first and second lateral edges, and a plurality of holes. The main panel has ruler-markings adjacent to the first and second lateral edges. The main panel is rectangular in shape. The tab perpendicularly extends from the front face separated a predetermined distance from the bottom edge, and the ridge perpendicularly extends from the bottom edge at the rear face. The tab and the ridge measure clearances and gaps between siding and trim products with solid surfaces building elements.

18 Claims, 3 Drawing Sheets

(56) References Cited

U.S. PATENT DOCUMENTS

| | | | | |
|---|---|---|---|---|
| D897,193 | S * | 9/2020 | Sokoly | D8/367 |
| 11,142,916 | B2 * | 10/2021 | LePoire | F16B 15/0046 |
| 2009/0133279 | A1 | 5/2009 | Gorman et al. | |
| 2012/0187265 | A1 * | 7/2012 | Bakerman | B60R 7/12 248/220.22 |

* cited by examiner

CEMENT SIDING TOLERANCE DEVICE AND MEASUREMENT TOOL

II. BACKGROUND OF THE INVENTION

1. Field of the Invention

The present invention relates to measurement tools, and more particularly, to cement height-measuring devices for gap siding and trim to solid surfaces.

2. Description of the Related Art

Applicant believes that one of the closest references corresponds to U.S. Pat. No. 5,465,499 A issued to LaPlante on Nov. 14, 1995 for Tool for installing siding. However, it differs from the present invention because LaPlante teaches a tool for installing siding on a building wall wherein only two formed metal parts are shown, which are of utter simplicity and are relatively adjustable one to the other to provide variation in desired exposure to weather of each underlying siding member as determined by the positioning of the parts in assembled relation. A generally J-shaped bracket and an adjustable U-shaped siding support are provided with the support being releasably attached to the bracket with a pair of legs on the support extending through a pair of a series of openings in the bracket. The bracket has a lower hook with a reversely bent lip, which may be inserted into wedged engagement between a building wall and an affixed strip of siding for readily securing the tool in position to enable a leg of the support to provide the only assistance required for a single worker to install an overlying strip of siding.

Applicant believes that another reference corresponds to U.S. Pat. No. 5,950,321 A issued to Pena, et al. on Sep. 14, 1999 for adhesive tape measurement for lap-siding building construction. However, it differs from the present invention because Pena, et al. teach an adhesive tape that includes a plurality of marks that facilitate the installation of lap-siding members on a building. The tape is adhered to a wall in a vertical orientation, and the lap siding members are nailed in place over the tape. The marks function as guides for the positioning of the lap-siding members. The tapes are essentially free of indicia that can be confused with the marks to generate measurement errors in during the installation process.

Applicant believes that another reference corresponds to U.S. Pat. No. 6,684,521 B2 issued to Rempe on Feb. 3, 2004 for Siding gauge tool. However, it differs from the present invention because Rempe teaches a tool that comprises a clamp and lip arrangement for clamping and supporting a panel on a previously installed panel, a handle extending from the clamp, a first gauge for setting the overlap between successive panels, a second gauge for marking or drilling nail installation locations, and an arrangement for changing the amount of overlap between successive panels. In use, one or more of the tools are clamped along the bottom edge of a panel being installed and the tool supported by the lip on the upper edge of the previously installed board, enabling the installer to temporarily tack the new panel in place. The tool(s) can then be removed from the new piece by twisting and pulling down on the handle portion. The second gauge is used to mark/drill the nail installation locations, prior to or after tacking.

Applicant believes that another reference corresponds to U.S. Pat. No. 6,705,021 B2 issued to Nadal, et al. on Mar. 16, 2004 for Lap siding installation tool. However, it differs from the present invention because Nadal, et al. teach a tool that includes a body having a handle and a pair of vertically spaced-apart seat assemblies that define a seat distance there between. The lower seat assembly is adapted to engage the lower portion of a previously installed siding piece, and the upper seat assembly is adapted to support the lower portion of a siding piece to be installed at the determined reveal distance relative to the previously installed siding piece. The reveal distance is at least substantially defined by the seat distance. The tool enables two or more installers to with one hand properly hold and provide for level alignment of the piece of lap siding to be installed, while at the same time enabling the installers to mechanically fasten the same with the other hand. In some embodiments, the tool is adjustable to accommodate a range of reveal sizes.

Applicant believes that another reference corresponds to U.S. Pat. No. 6,836,969 B1 issued to Bates on Jan. 4, 2005 for Sliding gauge for making measured markings. However, it differs from the present invention because Bates teaches a hand held device for making measured markings. The device comprises a body having a bottom and a side surface with a butting surface connected to the body having a flat face perpendicular to the body to slidably butt against an edge of a work piece. A plurality of spaced guiding wells adjacent the side surface may receive a marking instrument point. The guiding wells simultaneously provide measurement and guidance for the marking instrument while the butting surface is slid along the edge of a work piece. A telescoping member having a flat top edge provides adjustable guidance for marking instrument as well. Reference markings on the telescoping member mark distance from the edge of the telescoping member to the butting surface. A fixing means may adjustably fix the relationship between the telescoping member and the body. The telescoping member is extendable to distance shown by the reference markings.

Applicant believes that another reference corresponds to U.S. Pat. No. 6,886,268 B1 issued to Morse on May 3, 2005 for Siding installation tool and method of installing siding. However, it differs from the present invention because Morse teaches a siding installation tool comprising a main body portion including a spacing flange. The spacing flange includes a hook member disposed to hang the tool from a top edge of a first siding panel and a seat member disposed to receive the bottom edge of a second siding panel, wherein the flange portion is sized to provide a partial overlap of the first siding panel by the second siding panel when the tool is attached to the first siding panel by the hook member and the second siding panel is seated in the seat. The tool also includes measuring means located on the tool.

Applicant believes that another reference corresponds to U.S. Pat. No. 7,159,328 B1 issued to Duda on Jan. 9, 2007 for measurement gauge incorporating a level. However, it differs from the present invention because Duda teaches an apparatus having a handle for manipulating the device and an extending rule portion having a series of markings or measurements embossed along its edge serving as a base of spacing measurement for a pivotally mounted swing arm and a slide arm perpendicularly attached thereto that may be adjusted to a desired distance. After a desired distance is set the swing arm serves to maintain spacing and parallelism by having a bubble level fabricated into each of its ends to test if the materials held flush are level. After correct measurements are made the apparatus may then be used as a gauging tool for the quick and ready spacing and setting of materials afterwards.

Applicant believes that another reference corresponds to U.S. Pat. No. 7,490,447 B2 issued to Ouellette, et al. on Feb.

17, 2009 for Siding tool. However, it differs from the present invention because Ouellette, et al. teach a tool for efficiently hanging a siding plank on a wall in overlapping relation to a previously attached siding plank. The tool can be secured to a siding plank previously attached to a wall without using a hook that extends behind the previously attached siding plank. These features make the tool more convenient to use and allow the siding job to proceed more quickly. The tool is formed from an elongated base member. A first lip and a second lip project a predetermined distance from the same side of the elongated base member at opposing first and second ends thereof. A shelf or ledge is also provided on the elongated base member.

Applicant believes that another reference corresponds to U.S. Pat. No. 7,574,814 B2 issued to Larsson on Aug. 18, 2009 for Apparatus for aligning lapboard siding. However, it differs from the present invention because Larsson teaches a pair of generally linear templates that include one vertical edge convolved in substantially identical stepped convolutions that are each respectively conformed to support the lower end edges of an array of lapboards on the exterior of a building wall structure. Each of the templates include a set of laterally offset attachment brackets provided with spring opposed fasteners that are useful to temporarily secure the templates to the wall structure at a securement interval that is greater than the span of the lapboards, thus exposing the lapboard ends for their proper alignment as the lapboards are affixed to the wall structure.

Applicant believes that another reference corresponds to U.S. Pat. No. 8,359,762 B1 issued to Blasi on Jan. 29, 2013 for Wall siding board installation tool. However, it differs from the present invention because Blasi teaches a wall siding board installation tool including a quill and shaft assembly having upper ends; a board top hooking member and a board bottom hooking member, the board top and bottom hooking members defining a hook; the board top hooking member being fixedly attached to an upper end selected from the group consisting of the quill upper end and the shaft upper end, the board bottom hooking member being fixedly attached to the other upper end; and a hook extending and retracting lever and actuator arm assembly connected operatively to the quill and shaft assembly, the lever and actuator arm assembly being adapted for moving the quill or the shaft between a board suspending position and a tool releasing position, the board top and bottom hooking members being displaced a calibrated lap joint distance away from each other upon movement to the suspending position.

Applicant believes that another reference corresponds to U.S. Pat. No. 9,206,613 B2 issued to Walker on Dec. 8, 2015 for Siding installation tool. However, it differs from the present invention because Walker teaches an improved panel siding installation device that enables a worker installing panel siding on a building structure such as a house to accurately and efficiently measure the distance between edges of adjacent siding panels. This distance is known as the "reveal distance" of the lap siding. In addition to accurately measuring the distance between edges of siding panels.

Applicant believes that another reference corresponds to U.S. Pat. No. 9,951,534 B2 issued to Menges on Apr. 24, 2018 for Siding gauge for measuring vertical gap and horizontal overlap. However, it differs from the present invention because Menges teaches a device for maintaining recommended spacing during siding installation that contains a main body, an extended body, an extruding body, a first channel, and a second channel. The first channel and the second channel are used to receiving a siding panel. When the siding panel is received, a first stop and a second stop of the extruding body is used to rest the device against a previously installed siding panel. Since the siding panel is stationary against the previously installed siding panel, a constant space can be maintained between the two siding panels. In addition to installing the siding panel, the device can also be used when installing siding butt-joints.

Applicant believes that another reference corresponds to U.S. Pat. No. 10,544,594 B2 issued to Merrick, et al. on Jan. 28, 2020 for Self-spacing lap siding product. However, it differs from the present invention because Merrick, et al. teach a lap siding product with a unique shiplap joint that spaces abutting pieces of siding correctly from each other without installer measurements. The shiplap joint comprises a bottom element and a top element. A lap siding panel or board has a bottom element shiplap joint at one end, and a top elements shiplap joint at the other end. The corresponding ends of two lap siding panels or boards together form a unique shiplap joint. An engineered "stop" on the underside of the top element spaces the pieces of siding correctly, without requiring measurement during installation. This also eliminates the need for caulk, pan flashing or joint covers in the joint between the pieces of siding or cladding. The shape of the joint also reduces the intrusion of water, and re-directs water down and out from behind the siding.

Applicant believes that another reference corresponds to U.S. Patent Application Publication No. 2009/0133279 A1, published on May 28, 2009 to Gorman, et al. for Shingle hanging tool. However, it differs from the present invention because Gorman, et al. teach a tool for alignment of siding and roofing materials including but not limited to shingles. The tool includes a means of affixing a ledger board of other guidance or measurement device. The tool allows the use of a ledger board without compromising the integrity of the shingles.

Other patents describing the closest subject matter provide for a number of more or less complicated features that fail to solve the problem in an efficient and economical way. None of these patents suggest the novel features of the present invention.

III. SUMMARY OF THE INVENTION

The present invention is a cement siding tolerance device and measurement tool comprising a main panel having a tab and a ridge, whereby the tab and the ridge perpendicularly extend from the main panel at opposite sides.

The main panel comprises a front face, a rear face, a top edge, a bottom edge, first and second lateral edges, and a plurality of holes. The main panel further comprises ruler-markings adjacent to the first and second lateral edges. The main panel is rectangular in shape.

The holes are rectangular in shape and extend from the front face to the rear face. The plurality of holes are distributed between the top edge and the tab, spaced-apart each other a predetermined distance.

The tab perpendicularly extends from the front face separated a predetermined distance from the bottom edge. The tab comprises a tab top face and a tab bottom face. The tab further comprises a tab interior edge, a tab exterior edge, and first and second tab lateral edges. The tab extends from the first lateral edge to the second lateral edge.

The ridge perpendicularly extends from the bottom edge at the rear face. The ridge comprises a ridge top face and a ridge bottom face. The ridge further comprises a ridge interior edge, a ridge exterior edge, and first and second ridge lateral edges. The ridge extends from the first lateral edge to the second lateral edge.

From the tab to the top edge there is a first predetermined distance and from the tab to the bottom edge there is a second predetermined distance, wherein the first predetermined distance is larger than the second predetermined distance.

From the tab interior edge to the tab exterior edge there is a first predetermined distance, and from the ridge interior edge to the ridge exterior edge there is a second predetermined distance, wherein the first predetermined distance is larger than the second predetermined distance.

From the tab top face to the tab bottom face there is a first predetermined distance and from the ridge top face to the ridge bottom face there is a second predetermined distance, wherein the first predetermined distance and the second predetermine distance are approximately the same.

From the front face to the rear face there is a third predetermined distance, wherein the first predetermined distance and the second predetermined distance are larger than the third predetermined distance. The tab and the ridge allow to measure clearances or gaps.

It is therefore one of the main objects of the present invention to provide cement siding tolerance device and measurement tools.

It is another object of this invention to provide a cement siding tolerance device and measurement tool to measure required clearances/gaps between sidings and trim products with other solid surface building elements for a siding-type installation.

It is another object of this invention to provide a cement siding tolerance device and measurement tool that is volumetrically efficient for carrying, transporting, and storage.

It is another object of this invention to provide a cement siding tolerance device and measurement tool, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
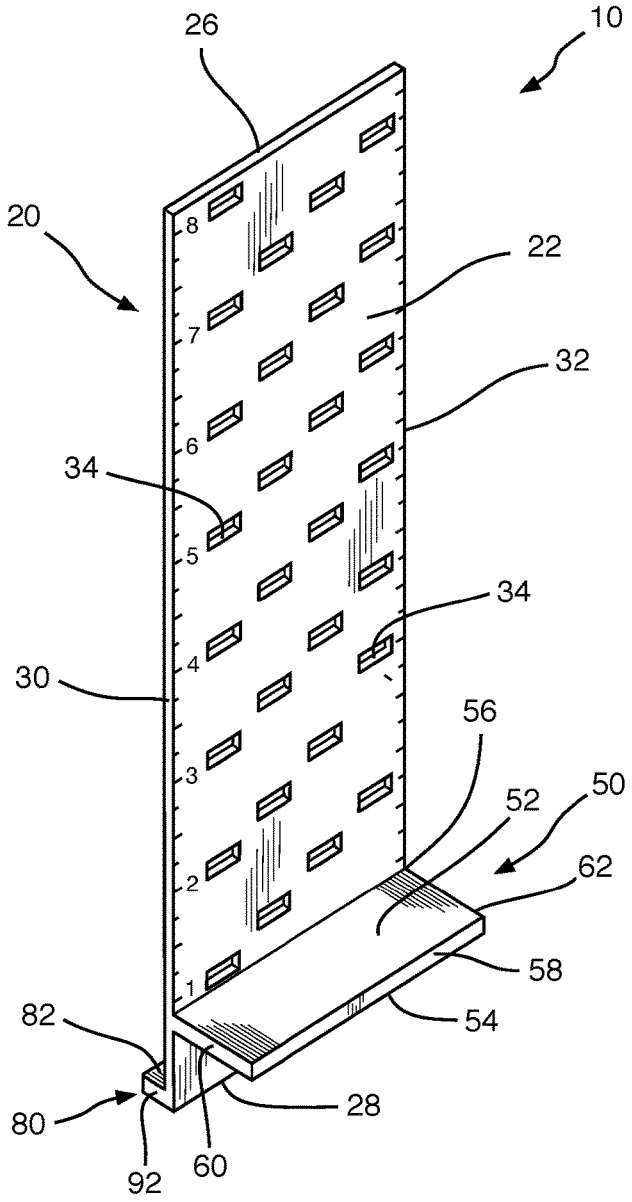
FIG. 1 is a front isometric view of the present invention.

Referring now to the drawings, the present invention is a cement siding tolerance device and measurement tool, and is generally referred to with numeral 10. It can be observed that it basically includes main panel 20, tab 50, and ridge 80.

Figure 2:
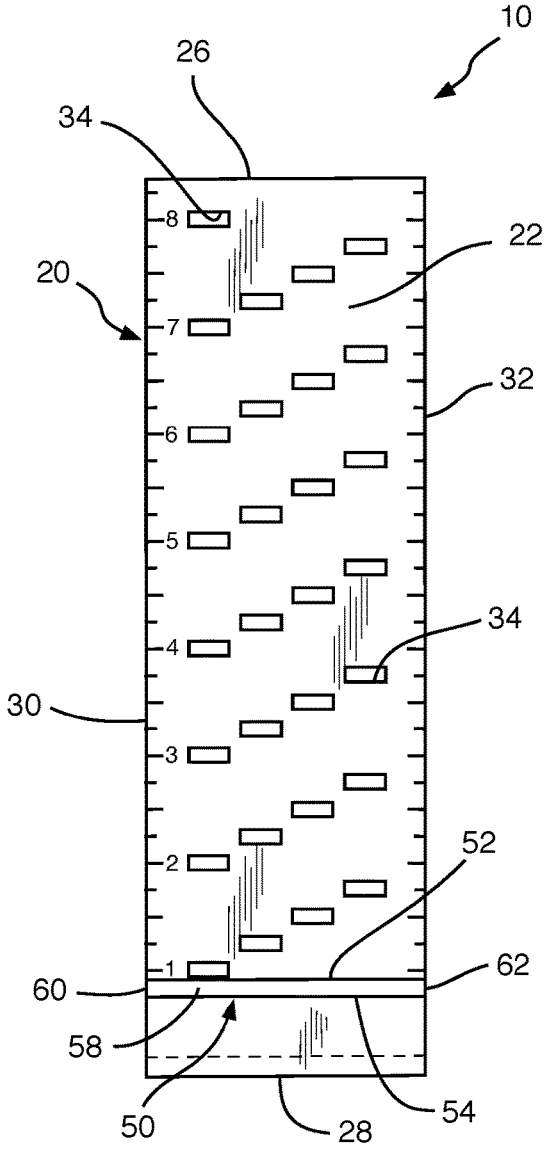
FIG. 2 is a front view of the present invention.

As seen in FIGS. 1 and 2, main panel 20 comprises tab 50 and ridge 80, whereby tab 50 and ridge 80 perpendicularly extend from main panel 20 at opposite sides.

Figure 3:
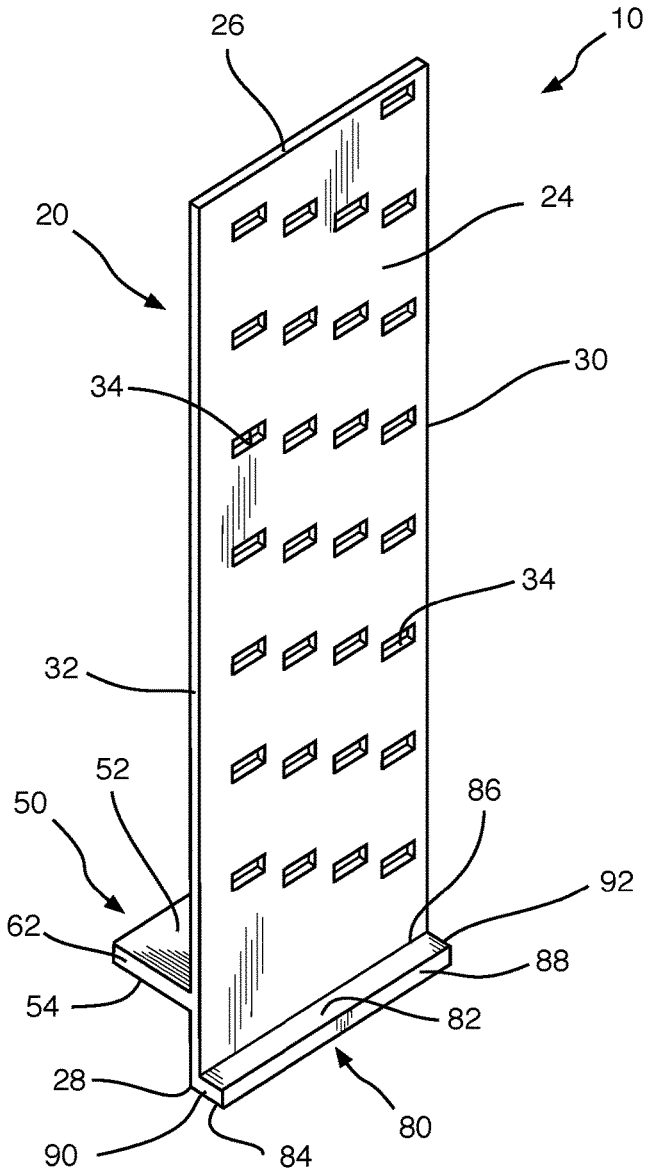
FIG. 3 is a rear isometric view of the present invention.

Main panel 20 comprises front face 22, and rear face 24 seen in FIG. 3. Main panel 20 further comprises top edge 26, bottom edge 28, first and second lateral edges 30 and 32, and a plurality of holes 34. In a preferred embodiment, tab 50 perpendicularly extends from front face 22, and ridge 80 perpendicularly extends from rear face 24. Furthermore, in a preferred embodiment, holes 34 are staggered in a repetitive diagonal fashion. In a preferred embodiment, main panel 20 comprises ruler-markings adjacent to first and second lateral edges 30 and 32 on front face 22. In a preferred embodiment, main panel 20 is rectangular in shape.

In a preferred embodiment, the ruler-markings are ¼ inch increments. In alternate embodiments, the ruler-markings may be any increments including, but not limited, to 1 inch, ¾ inch, ½ inch, ⅛ inch, 1/16 inch, 1/32 inch, etc. In addition, present invention 10 may comprise metric system ruler-markings that may be any increments including, but not limited to, decimeters, centimeters, millimeters, etc.

In one embodiment, holes 34 are rectangular in shape, and extend from front face 22 to rear face 24. In one embodiment, holes 34 are diagonally distributed or staggered between top edge 26 and tab 50, spaced-apart from each other a predetermined distance. In a preferred embodiment, each of holes 34 is positioned every ¼ inch, which corresponds to a respective set of ruler-markings that are also in ¼ inch increments. A set of ruler-markings being defined as a same measurement across front face 22.

Tab 50 perpendicularly extends from front face 22 and is separated a predetermined distance from bottom edge 28. Tab 50 comprises tab top face 52 and tab bottom face 54. Tab 50 further comprises tab interior edge 56, tab exterior edge 58, and first and second tab lateral edges 60 and 62. Tab 50 extends from first lateral edge 30 to second lateral edge 32.

From tab top face 52 to top edge 26 there is a first predetermined distance, and from tab top face 52 to bottom edge 28 there is a second predetermined distance, whereby the first predetermined distance from tab top face 52 to top edge 26 is larger than the second predetermined distance from tab top face 52 to bottom edge 28. In a preferred embodiment, the second predetermined distance from tab top face 52 to bottom edge 28 is approximately 1 inch.

As seen in FIG. 3, ridge 80 perpendicularly extends from bottom edge 28 at rear face 24. Ridge 80 comprises ridge top face 82 and ridge bottom face 84. Ridge 80 further comprises ridge interior edge 86, ridge exterior edge 88, and first and second ridge lateral edges 90 and 92. Ridge 80 extends from first lateral edge 30 to second lateral edge 32.

Figure 4:
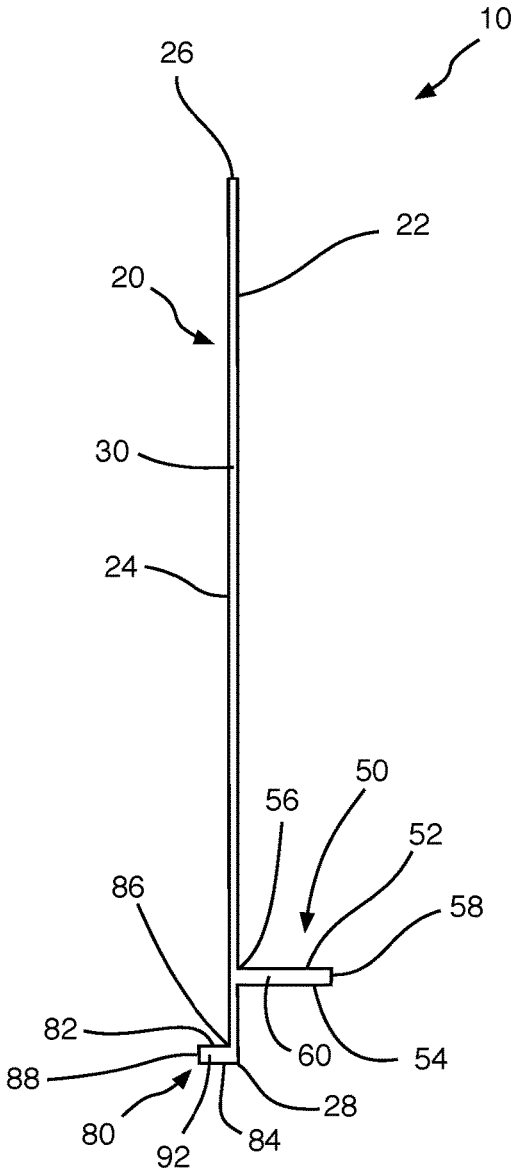
FIG. 4 is a side view of the present invention.

As seen in FIGS. 3 and 4, from tab top face 52 to tab bottom face 54 there is a first predetermined distance, and from ridge top face 82 to ridge bottom face 84 there is a second predetermined distance, wherein the first predetermined distance from tab top face 52 to tab bottom face 54 and the second predetermine distance from ridge top face 82 to ridge bottom face 84 are approximately the same. In a preferred embodiment, the first predetermined distance from tab top face 52 to tab bottom face 54 and the second predetermined distance from ridge top face 82 to ridge bottom face 84 are approximately ¼ inch. From front face 22 to rear face 24 there is a third predetermined distance, wherein the first predetermined distance from tab top face 52 to tab bottom face 54 and the second predetermined distance from ridge top face 82 to ridge bottom face 84 are larger than the third predetermined distance from front face 22 to rear face 24. In a preferred embodiment, the third predetermined distance is ⅛ inch.

Figure 5:
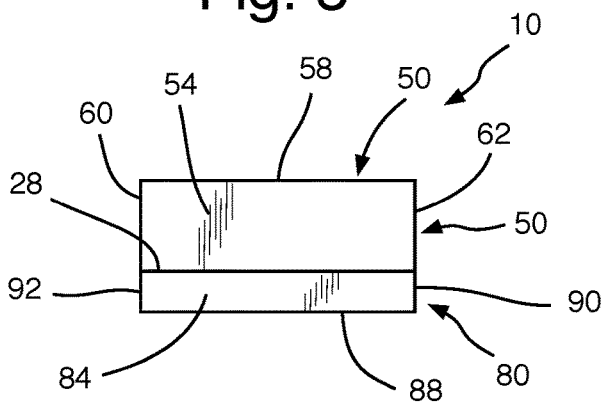
FIG. 5 is a bottom view of the present invention.

As seen in FIGS. 4 and 5, from tab interior edge 56 to tab exterior edge 58 there is a first predetermined distance, and from ridge interior edge 86 to ridge exterior edge 88 there is a second predetermined distance, wherein the first predetermined distance from tab interior edge 56 to tab exterior edge 58 is larger than the second predetermined distance from ridge interior edge 86 to ridge exterior edge 88.

Figure 6:
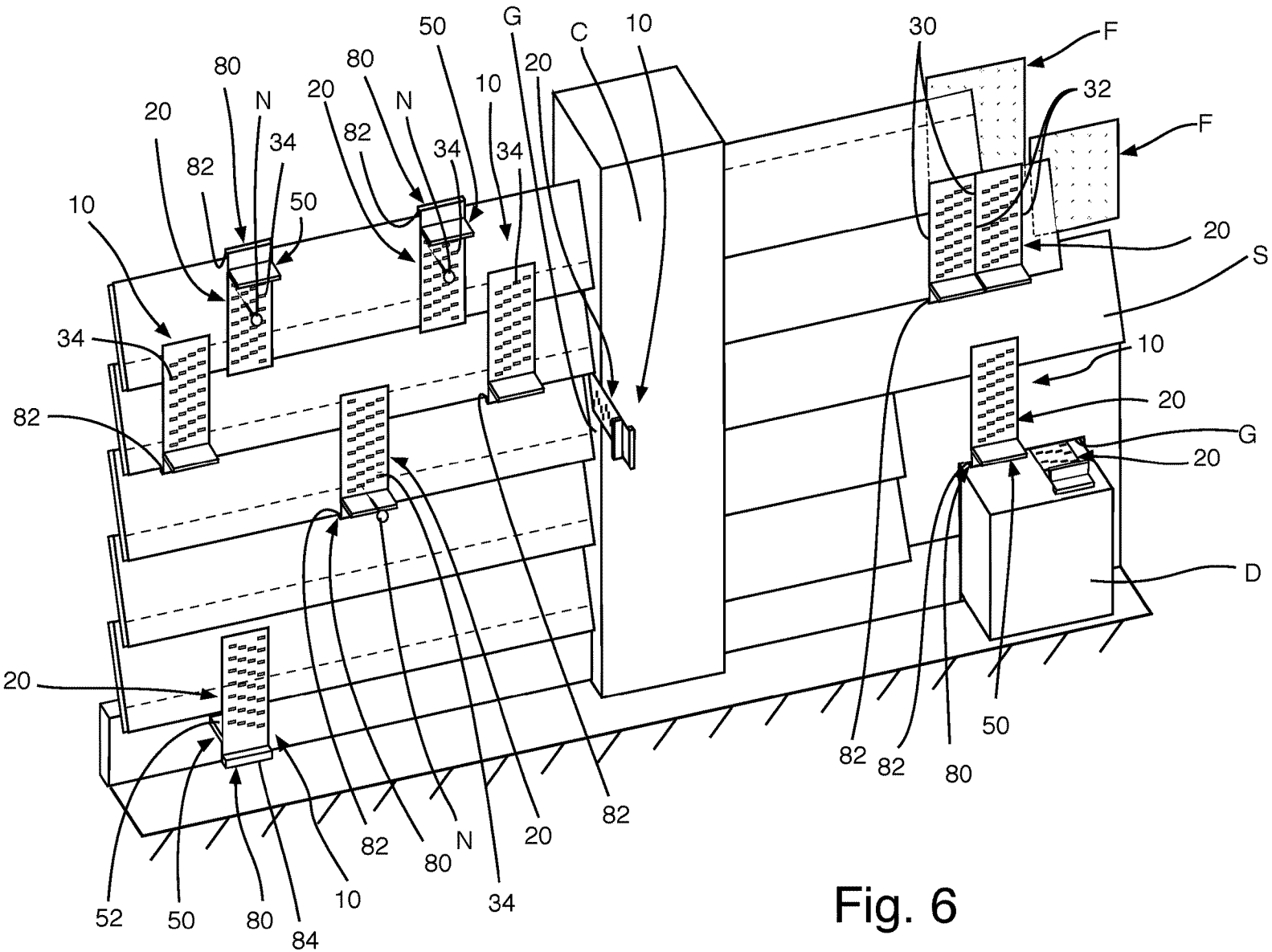
FIG. 6 is a view of a plurality of the present invention in use.

Illustrated in FIG. 6 are a plurality of present invention 10 for illustrative purposes of different uses, as a cement siding tolerance device and measurement tool used to confirm required measurements for clearances between horizontal sidings S, as well as gaps G between horizontal sidings S and columns C and solid devices D positioned into or onto walls. It is understood that each person/worker will utilize one or two of present invention 10 while working. Holes 34 receive nails N or marking instruments, including pencils, pens, and/or markers, to mark/drill at nail N installation locations at siding S.

Main panel 20 is used to measure gap G between sidings S and columns C, whereby main panel 20 is inserted into gap G between sidings S and columns C. A required measurement of gap G between sidings S and columns C in a preferred embodiment is ⅛ inch, whereby from front face 22 to rear face 24 there is approximately ⅛ inch.

Tab 50 and ridge 80 measure clearances or gap G required on sidings S and trim products with other solid surface building elements. In a preferred embodiment, tab 50 and ridge 80 measure clearances or gap G required in horizontal sidings S and between horizontal sidings S and solid devices D. Tab 50 or ridge 80 are inserted between horizontal sidings S and solid devices D to measure gap G. A required measure of gap G between horizontal sidings S and solid devices D in a preferred embodiment is ¼ inch, whereby from tab top face 52 to tab bottom face 54 there is approximately ¼ inch, and from ridge top face 82 to ridge bottom face 84 there is approximately ¼ inch.

Ridge 80 at a bottom of sidings S may also verify the same distance from left to right. First lateral edge 30 and second lateral edge 32 are used to verify that siding S is installed square or level. Main panel 20 is also used to measure flashings F position, whereby equal flashing F portions should be at both sides of a joint. In a preferred embodiment, flashings F should be 6 inches wide, and from first lateral edge 30 to second lateral edge 32 there is approximately 3 inches, therefore a remaining portion of flashing F at a joint has approximately the same width of main panel 20.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cement siding tolerance device and measurement tool comprising a main panel having a top edge, a bottom edge, first and second lateral edges, a plurality of holes, a tab and a ridge, whereby said tab and said ridge perpendicularly extend from said main panel at opposite sides, said plurality of holes are rectangular in shape extending from said front face to said rear face, and positioned in stepped staggered rows with matching columns forming an array.

2. The cement siding tolerance device and measurement tool set forth in claim 1, wherein said main panel comprises a front face and a rear face.

3. The cement siding tolerance device and measurement tool set forth in claim 1, wherein said main panel comprises ruler-markings adjacent to said first and second lateral edges.

4. The cement siding tolerance device and measurement tool set forth in claim 1, wherein said main panel is rectangular in shape.

5. The cement siding tolerance device and measurement tool set forth in claim 1, wherein said plurality of holes are distributed between said top edge and said tab, spaced-apart from each other a predetermined distance.

6. The cement siding tolerance device and measurement tool set forth in claim 1, wherein said tab perpendicularly extends from said front face and is separated a predetermined distance from said bottom edge.

7. The cement siding tolerance device and measurement tool set forth in claim 1, wherein said tab comprises a tab top face and a tab bottom face.

8. The cement siding tolerance device and measurement tool set forth in claim 1, wherein said tab further comprises a tab interior edge, a tab exterior edge, and first and second tab lateral edges.

9. The cement siding tolerance device and measurement tool set forth in claim 1, wherein said tab extends from said first lateral edge to said second lateral edge.

10. The cement siding tolerance device and measurement tool set forth in claim 1, wherein said ridge perpendicularly extends from said bottom edge at said rear face.

11. The cement siding tolerance device and measurement tool set forth in claim 7, wherein said ridge comprises a ridge top face and a ridge bottom face.

12. The cement siding tolerance device and measurement tool set forth in claim 8, wherein said ridge further comprises a ridge interior edge, a ridge exterior edge, and first and second ridge lateral edges.

13. The cement siding tolerance device and measurement tool set forth in claim 1, wherein said ridge extends from said first lateral edge to said second lateral edge.

14. The cement siding tolerance device and measurement tool set forth in claim 1, wherein from said tab top face to said top edge there is a first predetermined distance and from said tab top face to said bottom edge there is a second predetermined distance, wherein said first predetermined distance is larger than said second predetermined distance.

15. The cement siding tolerance device and measurement tool set forth in claim 12, wherein from said tab interior edge to said tab exterior edge there is a first predetermined distance, and from said ridge interior edge to said ridge exterior edge there is a second predetermined distance wherein said first predetermined distance is larger than said second predetermined distance.

16. The cement siding tolerance device and measurement tool set forth in claim 11, wherein from said tab top face to said tab bottom face there is a first predetermined distance and from said ridge top face to said ridge bottom face there is a second predetermined distance, wherein said first predetermined distance and said second predetermined distance are approximately the same.

17. The cement siding tolerance device and measurement tool set forth in claim 16, wherein from said front face to said rear face there is a third predetermined distance, wherein said first predetermined distance and said second predetermined distance are larger than said third predetermined distance.

18. The cement siding tolerance device and measurement tool set forth in claim 1, wherein said tab and said ridge measure clearances and gaps.

* * * * *